US007825050B2

(12) United States Patent
Wilfong et al.

(10) Patent No.: US 7,825,050 B2
(45) **Date of Patent: *Nov. 2, 2010**

(54) VOC-ABSORBING NONWOVEN COMPOSITES

(75) Inventors: David E. Wilfong, Greenville, SC (US); Wei Xiao, Spartanburg, SC (US); Gregory J. Thompson, Simpsonville, SC (US); Raymond C. Sturm, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 402 days.

This patent is subject to a terminal disclaimer.

(21) Appl. No.: 11/890,214

(22) Filed: Aug. 3, 2007

(65) Prior Publication Data

US 2008/0153375 A1 Jun. 26, 2008

Related U.S. Application Data

(60) Provisional application No. 60/871,568, filed on Dec. 22, 2006.

(51) Int. Cl.

| | |
|---|---|
| ***B32B 5/26*** | (2006.01) |
| ***D04H 1/00*** | (2006.01) |
| ***D04H 13/00*** | (2006.01) |
| ***D04H 3/00*** | (2006.01) |

(52) U.S. Cl. ..... 442/381; 442/121; 442/415; 442/417; 156/308.2; 264/258

(58) Field of Classification Search ..... 442/415, 442/417, 121, 381; 156/308.2; 264/258
See application file for complete search history.

(56) References Cited

U.S. PATENT DOCUMENTS

| | | | |
|---|---|---|---|
| 2,500,282 | A | 3/1950 | Francis, Jr. |
| 2,543,101 | A | 2/1951 | Francis, Jr. |
| 3,041,703 | A | 7/1962 | Prell |
| 3,073,735 | A | 1/1963 | Till et al. |
| 3,254,300 | A | 5/1972 | Brown et al. |
| 3,688,804 | A | 9/1972 | Brown et al. |
| 3,740,797 | A | 6/1973 | Farrington |

(Continued)

FOREIGN PATENT DOCUMENTS

| | | | |
|---|---|---|---|
| AT | 411 270 | B | 11/2003 |

(Continued)

OTHER PUBLICATIONS

Patent Cooperation Treaty PCT International Search Report. International application No. PCT/US2007/025710, International filing date Dec. 14, 2007.

(Continued)

*Primary Examiner*—Norca L Torres-Velazquez
(74) *Attorney, Agent, or Firm*—Cheryl J. Brickey

(57) ABSTRACT

A nonwoven composite has a first surface, a second surface, and a thickness extending between the first and second surfaces. The nonwoven composite comprises a plurality of natural fibers, a plurality of binder fibers, and a VOC-absorbing material. The binder fibers are bonded to or interlocked with the natural fibers. The VOC-absorbing material is dispersed within the nonwoven composite in such a manner that the density of the VOC-absorbing material in the nonwoven composite is greatest adjacent to the second surface of the nonwoven composite. A method for producing a nonwoven composite is also described.

6 Claims, 9 Drawing Sheets

U.S. PATENT DOCUMENTS 3,772,739 A 11/1973 Lovgren
3,837,995 A 9/1974 Floden
4,018,646 A 4/1977 Ruffo et al.
4,082,886 A 4/1978 Butterworth et al.
4,127,698 A 11/1978 Shimizu et al.
4,194,037 A 3/1980 Stoller
4,418,031 A 11/1983 Doerer et al.
4,435,468 A 3/1984 Ten Eyck
4,474,846 A 10/1984 Doerer et al.
4,568,581 A 2/1986 Peoples, Jr.
4,666,763 A 5/1987 King et al.
4,714,647 A 12/1987 Shipp, Jr. et al.
4,840,832 A 6/1989 Weinle et al.
4,863,797 A 9/1989 Ichibori et al.
4,931,357 A 6/1990 Marshall et al.
4,970,111 A 11/1990 Smith, Jr.
5,001,331 A 3/1991 Leestemaker
5,039,431 A 8/1991 Johnson et al.
5,079,074 A 1/1992 Steagall et al.
5,108,678 A 4/1992 Hirasaka et al.
5,141,805 A 8/1992 Nohara et al.
5,147,345 A 9/1992 Young et al.
5,173,355 A 12/1992 Vock et al.
5,182,060 A 1/1993 Berecz
5,200,128 A 4/1993 Kiss
5,208,105 A 5/1993 Ichibori et al.
5,348,796 A 9/1994 Ichibori et al.
5,350,624 A 9/1994 Georger et al.
5,399,423 A 3/1995 McCullough et al.
5,407,739 A 4/1995 McCullough et al.
5,409,573 A 4/1995 Weeks
5,458,960 A 10/1995 Nieminen et al.
5,508,102 A 4/1996 Georger et al.
5,537,718 A 7/1996 Nagatsuka et al.
5,558,832 A 9/1996 Noel et al.
5,571,604 A 11/1996 Sprang et al.
5,578,368 A 11/1996 Forsten et al.
5,591,289 A 1/1997 Souders et al.
5,614,285 A 3/1997 Gardill
5,674,339 A 10/1997 Groeger et al. ..... 156/145
5,679,296 A 10/1997 Kelman et al.
5,685,347 A 11/1997 Graham et al.
5,698,298 A 12/1997 Jackson et al.
5,723,209 A 3/1998 Borger et al.
5,733,635 A 3/1998 Terakawa et al.
5,766,745 A 6/1998 Smith et al.
5,817,408 A 10/1998 Orimo et al.
5,856,243 A 1/1999 Geirhos et al.
5,873,392 A 2/1999 Meyer et al.
5,916,507 A 6/1999 Dabi et al.
5,942,288 A 8/1999 Kajander
6,063,461 A 5/2000 Hoyle et al.
6,066,388 A 5/2000 Van Kerrebrouck
6,074,505 A 6/2000 Ouellette et al.
6,110,848 A 8/2000 Bouchette
6,127,021 A 10/2000 Kelman
6,177,370 B1 1/2001 Skoog et al.
6,204,207 B1 3/2001 Cederblad et al.
6,271,270 B1 8/2001 Muzzy et al.
6,322,658 B1 11/2001 Byma et al.
6,346,491 B1 2/2002 DeAngelis et al.
6,364,976 B2 4/2002 Fletemier et al.
6,494,362 B1 12/2002 Harmon
6,572,723 B1 6/2003 Tilton et al.
6,582,639 B2 6/2003 Nellis
6,586,353 B1 7/2003 Kiik et al.
6,609,261 B1 8/2003 Mortensen et al.
6,610,904 B1 8/2003 Thomas et al.
6,689,242 B2 2/2004 Bodaghi
6,702,914 B2 3/2004 North et al.
6,718,583 B1 4/2004 Diaz
6,734,335 B1 5/2004 Graef et al.
6,736,915 B2 5/2004 Gebreselassie et al.
6,746,760 B2 * 6/2004 Minemura et al. ..... 428/323
6,756,332 B2 6/2004 Sandoe et al.
6,764,971 B2 7/2004 Kelly et al.
6,774,068 B2 8/2004 Park
6,781,027 B2 8/2004 Fenwick et al.
6,797,653 B2 9/2004 Fay
6,936,554 B1 8/2005 Singer et al.
7,137,477 B2 11/2006 Keller et al.
7,318,498 B2 1/2008 Woodman et al. ..... 181/290
7,605,097 B2 * 10/2009 Thompson et al. ..... 442/408
7,651,964 B2 * 1/2010 Thompson et al. ..... 442/361
2001/0037854 A1 11/2001 Byma et al.
2003/0087572 A1 5/2003 Balthes et al.
2003/0100239 A1 5/2003 Gaffney et al.
2003/0106560 A1 6/2003 Griesbach et al.
2003/0118764 A1 * 6/2003 Adams et al. ..... 428/36.91
2003/0118814 A1 * 6/2003 Workman et al. ..... 428/365
2003/0162461 A1 8/2003 Balthes
2003/0199216 A1 10/2003 Gomez et al.
2003/0200991 A1 10/2003 Keck et al.
2003/0224145 A1 12/2003 Campion et al.
2003/0224679 A1 12/2003 Ahluwalis
2003/0228460 A1 12/2003 Ahluwalis
2004/0023586 A1 2/2004 Tilton
2004/0060118 A1 4/2004 Diaz
2004/0060119 A1 4/2004 Murphy et al.
2004/0062912 A1 4/2004 Mason et al.
2004/0091705 A1 5/2004 Hanyon et al.
2004/0097159 A1 5/2004 Balthes et al.
2004/0102112 A1 5/2004 McGuire et al.
2004/0106347 A1 6/2004 McGuire et al.
2004/0158928 A1 8/2004 Gladney
2004/0185239 A1 9/2004 Nakamura et al.
2004/0185731 A1 9/2004 McGuire
2004/0198125 A1 10/2004 Mater et al.
2004/0235983 A1 11/2004 Stadler et al.
2004/0242107 A1 12/2004 Collins
2004/0242109 A9 12/2004 Tilton et al.
2004/0259451 A1 12/2004 Paradis et al.
2005/0020164 A1 1/2005 Nakamura et al.
2005/0023509 A1 2/2005 Bascom et al.
2005/0026527 A1 2/2005 Schmidt et al.
2005/0026528 A1 2/2005 Forsten et al.
2005/0148268 A1 7/2005 Tai
2005/0170726 A1 8/2005 Byma et al.
2005/0170728 A1 8/2005 Crainic
2005/0176327 A1 8/2005 Wenstrup et al.
2006/0063458 A1 3/2006 McGuire
2006/0068675 A1 3/2006 Handermann et al.
2006/0099393 A1 5/2006 Woodman et al.
2006/0105661 A1 5/2006 Steinbach
2006/0182940 A1 8/2006 Cline
2006/0264142 A1 * 11/2006 Wenstrup et al. ..... 442/415
2007/0042658 A1 2/2007 Cline et al.
2007/0042665 A1 2/2007 Peng et al.

FOREIGN PATENT DOCUMENTS

DE 198 07 821 9/1999
EP 1 456 834 11/1976
EP 0 393 450 6/1990
EP 0 622 332 B1 7/1998
EP 1 400 328 A1 3/2004
JP 59-192754 11/1984
JP 4163254 6/1992
JP 5213138 8/1993
JP 06-200460 7/1994
JP 07-040487 2/1995
JP 08-506148 2/1996
JP 8060530 3/1996
JP 08-108439 4/1996

| | | | |
|---|---|---|---|
| JP | 08-323903 | | 12/1996 |
| JP | 09-216303 | | 8/1997 |
| JP | 09-220784 | | 8/1997 |
| JP | 09-313832 | | 12/1997 |
| JP | 10-110371 | | 4/1998 |
| JP | 10-147191 | | 6/1998 |
| JP | 10-180023 | | 7/1998 |
| JP | 10-236204 | | 9/1998 |
| JP | 10-236205 | | 9/1998 |
| JP | 10-236238 | | 9/1998 |
| JP | 10-245760 | | 9/1998 |
| JP | 10-95060 | | 10/1998 |
| JP | 11-058571 | | 3/1999 |
| JP | 11-061616 | | 3/1999 |
| JP | 11-217756 | | 8/1999 |
| JP | 11-268596 | | 10/1999 |
| JP | 2000-211417 | | 8/2000 |
| JP | 2001-232708 | | 8/2001 |
| JP | 2002-526296 | | 8/2002 |
| JP | 2003-305789 | | 10/2003 |
| JP | 2004-217052 | | 8/2004 |
| JP | 2004-524453 | | 8/2004 |
| JP | 2004-346436 | | 12/2004 |
| JP | 2004-360089 | A | 12/2004 |
| JP | 2005-053035 | | 3/2005 |
| WO | WO 02/076630 | A1 | 10/2002 |
| WO | WO 03/023108 | A1 | 3/2003 |
| WO | WO 2005/001187 | A1 | 1/2005 |
| WO | WO 2005/066396 | A1 | 7/2005 |
| WO | WO 2006/ 083144 | A1 | 8/2006 |
| WO | WO 2006/ 091031 | A1 | 8/2006 |
| WO | WO 2006/124305 | A1 | 11/2006 |

OTHER PUBLICATIONS

Additives—Reinforcing Polypropylene with Natural Fibers. Plastics Engineering / Apr. 1994. Anand R. Sanadi—Department of Forestry, University of Wisconsin, Madison, Wisconsin. Daniel F. Caulfield and Roger M. Rowell, Forest Products Laboratory—U.S. Department of Agriculture, Madison, Wisconsin.

1995 American Chemical Society. Ind. Eng. Chem. Res. 1995, 34, 1889-1896. Renewable Agricultural Fibers as Reinforcing Fillers in Plastics: Mechanical Properties of Kenaf Fiber-Polypropylene Composites. Anand R. Sanadi, Daniel F. Caulfield, Rodney E. Jacobson, and Roger M. Rowell. Department of Forestry, University of Wisconsin, 1630 Linden Drive, Madison, Wisconsin 53706, and Forest Products Laboratory, USDA, 1 Gifford Pinchot Drive, Madison, Wisconsin 53705.

National Renewable Energy Laboratory, Golden, Colorado. Proceedings—Second Biomass Conference of the Americas: Energy, Environment, Agriculture, and Industry. Aug. 21-24, 1995, Portland, Oregon.

Science and Technology of Polymers and Advanced Materials. Edited by P.N. Prasad et al., Plenum Press, New York, 1998. Property Enhanced Natural Fiber Composite Materials Based on Chemical Modification. Roger M. Rowell. USDA Forest Service, Forest Products Laboratory, One Gifford Pinchot Drive, Madison, WI 53705-2366 and Department of Biological Systems Engineering, University of Wisconsin, Madison, WI 63706.

Science and Technology of Polymers and Advanced Materials Edited by P.N. / Prasad et al., Plenum Press, New York, 1998. Economic Opportunities in Natural Fiber-Thermoplastic Composites. Roger M. Rowell. USDA Forest Products Laboratory, One Gifford Pinchot Drive, Madison, WI 53705-2366 and Department of Biological Systems Engineering, University of Wisconsin, Madison, WI 63706.

Plastics Technology Online Article—Natural Fibers: The New Fashion in Automotive Plastics—Oct. 1999. By Lilli Manolis Sherman, Senior Editor.

* cited by examiner

VOC-ABSORBING NONWOVEN COMPOSITES

CROSS REFERENCE TO RELATED APPLICATIONS

This application claims priority to U.S. application Ser. No. 60/871,568 filed on Dec. 22, 2006.

FIELD OF THE INVENTION

The invention relates to nonwoven materials and composites comprising a VOC-absorbing material.

BRIEF SUMMARY OF THE INVENTION

In a first embodiment, the invention provides a nonwoven composite having a first surface, a second surface, and a thickness extending between the first and second surfaces. The nonwoven composite comprises a plurality of natural fibers, a plurality of binder fibers, and a VOC-absorbing material. The binder fibers are bonded to or interlocked with the natural fibers. The VOC-absorbing material is dispersed within the nonwoven composite in such a manner that the density of the VOC-absorbing material in the nonwoven composite is greatest adjacent to the second surface of the nonwoven composite.

In a second embodiment, the invention provides a nonwoven composite having a first surface and a second surface. The nonwoven composite comprises a plurality of natural fibers and a plurality of binder fibers. The binder fibers are bonded to or interlocked with the natural fibers. The nonwoven composite further comprises a thermoplastic film disposed on at least one of the first and second surfaces of the nonwoven composite. The thermoplastic film comprises a VOC-absorbing material dispersed therein.

In a first method embodiment, the invention provides a method for producing a nonwoven composite comprising the steps of (a) providing a plurality of fiber binder fibers, a plurality of second binder fibers, and a plurality of natural fibers, (b) blending the pluralities of fibers to produce a fiber blend, (c) projecting the fiber blend onto a moving belt to form a fiber-containing composite, and (d) depositing a VOC-absorbing material onto a surface of the fiber-containing composite.

DETAILED DESCRIPTION OF THE INVENTION

Figure 1:
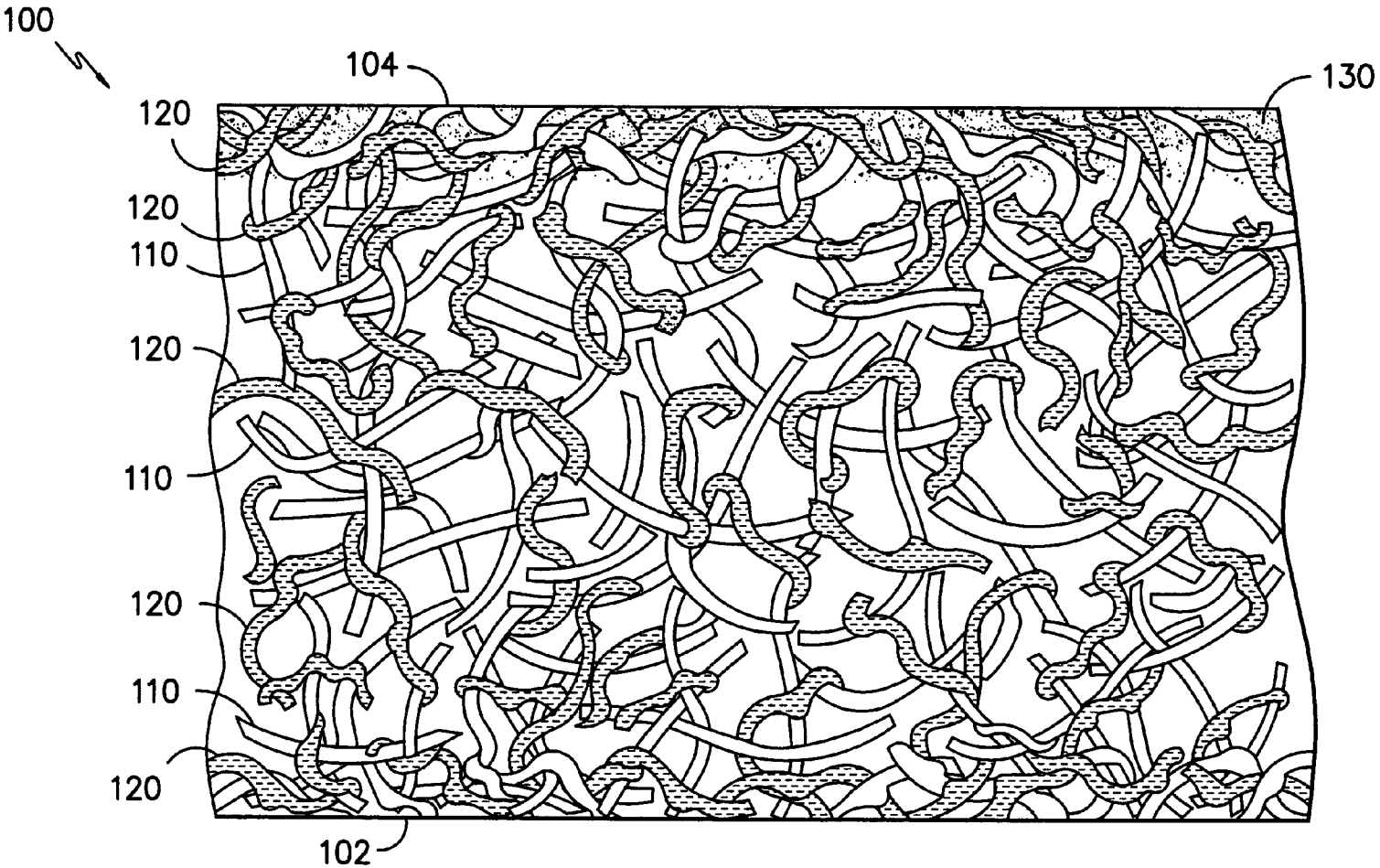
FIG. 1 is a sectional view of an embodiment of a nonwoven composite according to the invention.

In one embodiment, the invention provides a nonwoven composite comprising a plurality of fibers and a VOC-absorbing material. At least a portion of the plurality of fibers can be bonded (e.g., thermally fused, resin bonded, or solvent bonded) or mechanically interlocked (such as that produced by dry, wet or air laying, needlepunching, spunbond processes, and hydroentanglement) with each other to provide structure to the nonwoven composite.

The fibers present in the nonwoven composite can be any suitable fibers or combination thereof. Suitable fibers include natural fibers, synthetic fibers, and combinations thereof. In certain possibly preferred embodiments, the nonwoven composite comprises a plurality of natural fibers and a plurality of synthetic binder fibers.

Suitable natural fibers include, but are not limited to, fibers of animal origin (e.g., silk and wool), mineral origin, and plant or vegetable origin (e.g., cotton, flax, jute, and ramie). In certain possibly preferred embodiment, the plurality of natural fibers comprises bast fibers. As utilized herein, the term "bast fiber" refers to strong woody fibers obtained chiefly from the phloem of plants. Suitable bast fibers include, but are not limited to, jute, kenaf, hemp, flax, ramie, roselle, and combinations thereof. As utilized herein the term "bast fiber" also includes leaf fibers (e.g., fibers derived from sisal, banana leaves, grasses (e.g., bamboo), or pineapple leaves), straw fibers (e.g., fibers derived from wheat straw, rice straw, barley straw, or sorghum stalks), and husk fibers (e.g., fibers derived from corn husk, bagasse (sugar cane), or coconut husk). In certain possibly preferred embodiments, the bast fiber is jute.

The nonwoven composite can contain any suitable amount of the natural fiber(s). For example, the natural fibers can comprise about 30 to about 70 wt. %, about 35 to about 65 wt. %, about 45 to about 60 wt. %, about 50 to about 60 wt. %, or about 60 wt. % of the total weight of the nonwoven composite.

When present in the nonwoven composite, the binder fibers can comprise a thermoplastic material that is capable of at least partially melting when heated, thereby providing a means by which the binder fibers and other fibers can become interconnected within the fiber-containing composite. Suitable thermoplastic binder fibers include polyester fibers (e.g., polyethylene terephthalate (PET) fibers or glycol-modified PET (PETG) fibers), polyamide fibers (e.g., nylon 6 or nylon 6,6), polyethylene fibers (e.g., fibers containing high density polyethylene (HDPE) or linear low density polyethylene (LLDPE)), polypropylene fibers, polylactic acid fibers, fibers containing poly(1,4 cyclohexanedimethylene terephthalate) (PCT), cellulose fibers (e.g., rayon fibers), fibers containing 1,3-propanediol terephthalate, and combinations thereof. Suitable binder fibers also include, but are not limited to, bicomponent binder fibers (e.g., bicomponent binder fibers comprising a thermoplastic sheath) and thermoplastic binder fibers having a relatively low melt flow rate. Suitable bicomponent fibers include bicomponent, sheath-core fibers in which the sheaths have a lower melting point than the cores of the fibers. For example, the bicomponent, sheath-core fiber can have a polyethylene sheath (e.g., a high density polyethylene sheath) and a polypropylene or polyester core. Other suitable bicomponent fibers include fibers having a PET copolymer sheath and a PET core, a PCT sheath and polypropylene core, a PCT sheath and a PET core, a PETG sheath and a PET core, a HDPE sheath and a PET core, a HDPE sheath and a polypropylene core, a LLDPE sheath and a PET core, a polypropylene sheath and a PET core, or a nylon 6 sheath and a nylon 6,6 core. When such fibers are used in the disclosed composite, the composite can be heated so that the sheaths of the bicomponent fibers are melted to provide links between adjacent fibers within the composite, while the cores of the bicomponent fiber retain their fibrous structure. As noted above, the binder fibers can be thermoplastic binder fibers in which the thermoplastic material has a relatively low melt flow rate. For example, the melt flow rate of the thermoplastic fibers can be about 18 g/10 min. or less (e.g., about 8 g/10 min. or less), as determined in accordance with, for example, ASTM Standard D1238 entitled "Standard Test Method for Melt Flow Rates of Thermoplastics by Extrusion Plastometer." When such fibers are used in the disclosed composite, the composite can be heated so that the thermoplastic binder fibers are at least partially melted to provide links between adjacent fibers, while the relatively low melt flow rate of the thermoplastic material allows the binder fibers to retain their fibrous structure.

Suitable binder fibers made from thermoplastic materials, such as a polyolefin, can also contain coupling, compatabilizing, and/or mixing agents. While not wishing to be bound to any particular theory, it is believed that these agents can improve the interaction and/or bonding between the natural fibers and the binder material, thereby yielding a composite having better mechanical properties. Suitable coupling, compatabilizing, and mixing agents include, but are not limited to, titanium alcoholates; esters of phosphoric, phosphorous, phosphonic and silicic acids; metallic salts and esters of aliphatic, aromatic and cycloaliphatic acids; ethylene/acrylic or methacrylic acids; ethylene/esters of acrylic or methacrylic acid; ethylene/vinyl acetate resins; styrene/maleic anhydride resins or esters thereof; acrylonitrilebutadiene styrene resins; methacrylate/butadiene styrene resins (MBS), styrene acrylonitrile resins (SAN); butadieneacrylonitrile copolymers; and polyethylene or polypropylene modified polymers. Such polymers are modified by a reactive group including polar monomers such as maleic anhydride or esters thereof, acrylic or methacrylic acid or esters thereof, vinylacetate, acrylonitrile, and styrene. In certain possibly preferred embodiments, the binder fiber, or at least a portion of the binder fibers contained in the composite, is a polyolefin (e.g., polyethylene or polypropylene) or a copolymer thereof having maleic anhydride (MAH) grafted thereon.

The coupling, compatabilizing, and/or mixing agents can be present in the binder fibers in any suitable amount. For example, the agents can be present in the binder fibers in an amount of about 0.01 wt. % or more, about 0.1 wt. % or more, or about 0.2 wt. % or more, based on the total weight of the binder fiber. The agents can also be present in the binder fibers in an amount of about 20 wt. % or less, about 10 wt. % or less, or about 5 wt. % or less, based on the total weight of the binder fiber. In certain possibly preferred embodiments, the binder fibers contain about 0.01 to about 20 wt. % or about 0.1 to about 10 wt. % of the coupling, compatabilizing, and/or mixing agents, based on the total weight of the binder fiber. The amount of coupling, compatabilizing, and/or mixing agents included in the binder fiber can also be expressed in term of the number of moles of the coupling, compatabilizing, and/or mixing agents present per mole of the polymer from which the fiber is made. In certain possibly preferred embodiments, such as when the binder fiber comprises polypropylene and a maleic anhydride coupling agent, the binder fiber can contain about 5 to about 50 moles of maleic anhydride per mole of the polypropylene polymer.

The fiber-containing composite of the invention can contain any suitable combination of the binder fibers described above. For example, the binder fibers contained within the composite or a particular region of the composite can all have substantially the same composition or make-up, or the fibers can be a combination of fibers having different compositions. In certain possibly preferred embodiments, the binder fibers contained within the composite or a particular region of the composite can be polypropylene binder fibers having MAH grafted thereon (as described above), with the fibers within each of the region(s) having the linear densities specified below. In certain other embodiments, the binder fibers contained within the composite or a particular region of the composite can be a combination of polypropylene binder fibers having MAH grafted thereon and a second type of thermoplastic binder fibers, such as polyethylene fibers, polyester fibers, or bicomponent binder fibers (as described above). In order to provide a ready visual aid to confirming the appropriate blend of fibers in the composite, the different types of fibers (e.g., binder fibers having different deniers and/or different compositions) used to produce the composite can each be provided in a different color. Therefore, the presence of each fiber in the appropriate region of the composite can be quickly confirmed upon visual inspection of the composite during or after manufacture.

The fiber-containing composite described herein can comprise any suitable amount of binder fibers. For example, the binder fibers can comprise about 30 to about 70 wt. %, about 30 to about 60 wt. %, about 50 to about 40 wt. %, or about 40 wt. % of the total weight of the composite.

The nonwoven composite, in one embodiment, comprises a VOC-absorbing material. As utilized herein, the term "VOC-absorbing material" refers to a material that, upon exposure to an environment containing a volatile organic compound (VOC) in the gaseous phase, is capable of absorbing or adsorbing at least a portion of the VOC present within the environment. The term "VOC-absorbing material" is intended to include materials that operate by absorbing or taking up the VOC, as well as those materials that operate by adsorption, which is the adhesion in an extremely thin layer of molecules (as of gases, solutes, or liquids) to the surfaces of solid bodies or liquids with which they are in contact. The VOC-absorbing material can be any suitable material that is capable of absorbing at least a portion of a VOC present in an environment in the gaseous phase. Suitable VOC-absorbing materials include, but are not limited to, activated carbon, clays (e.g., organobentonites), zeolites, silica gels (e.g., modified silica gel), dendrimeric macromolecules, and combinations thereof. In certain possibly preferred embodiments, the VOC-absorbing material is activated carbon. The activated carbon can be derived from any suitable source, such as coal, coconut shells, and phenol formaldehyde resins.

The VOC-absorbing material can be present in the nonwoven composite in any suitable amount. In certain possibly preferred embodiments, the VOC-absorbing material can be present within the composite in an amount of about 3.4 $g/m^2$ or more (about 0.1 $oz/yd^2$ or more), about 8.5 $g/m^2$ or more (about 0.25 $oz/yd^2$ or more), 17 $g/m^2$ or more (0.5 $oz/yd^2$ or more), about 25 $g/m^2$ or more (about 0.75 $oz/yd^2$ or more), about 34 $g/m^2$ or more (about 1 $oz/yd^2$ or more), about 51 $g/m^2$ or more (about 1.5 $oz/yd^2$ or more), or about 68 $g/m^2$ or more (about 2 $oz/yd^2$ or more), based on the area of one of the major surfaces (e.g., top or bottom surface) of the nonwoven composite. Typically, the VOC-absorbing material is present within the composite in an amount of about 170 g/m$^2$ or less (about 5 oz/yd$^2$ or less), about 140 g/m$^2$ or less (about 4 oz/yd$^2$ or less), about 85 g/m$^2$ or less (about 3 oz/yd$^2$ or less), or about 102 g/m$^2$ or less (about 2.5 oz/yd$^2$ or less). The VOC-absorbing material can be distributed or dispersed throughout the nonwoven composite in any suitable manner. In certain possibly preferred embodiments, the density of the VOC-absorbing material within the nonwoven composite can be greatest adjacent to one of the surfaces of the nonwoven composite. The density of the VOC-absorbing material can, in certain other embodiments, vary through the thickness of the composite according to a gradient exhibiting a maximum density adjacent to one of the surfaces of the nonwoven composite.

In certain embodiments, the VOC-absorbing material can be used in combination with an adhesive, such as a thermoplastic or hot melt adhesive. The adhesive can serve to improve adhesion between the fibers within the composite and the VOC-absorbing material. As noted above, the adhesive can be a thermoplastic or hot melt adhesive, such as a copolyamide resin. When present, the adhesive can be present in any suitable amount. For example, in certain embodiments, the adhesive can be present in amount of about 50% to about 100% of the weight of the VOC-absorbing material.

In certain embodiments, the VOC-absorbing material can be incorporated into a film, such as a thermoplastic film, that is adhered to a surface of the composite. The film can be formed from any suitable thermoplastic material, such as a polyolefin (e.g., polyethylene, polypropylene, etc.), a polyamide, or a polyester (e.g., polyethylene terephthalate). The VOC-absorbing material can be incorporated into the film by, for example, adding the VOC-absorbing material to the thermoplastic material before the film is cast, blown, or otherwise formed. In such an embodiment, the VOC-absorbing material can be incorporated into the thermoplastic film in any suitable amount. For example, the VOC-absorbing material can be incorporated into the thermoplastic film in an amount so that, when the film is applied to the composite, the amount or concentration of VOC-absorbing material in the nonwoven composite falls within one or more of the ranges set forth above.

The nonwoven composite described herein can have any suitable weight and density. For example, the composite can have a weight of about 500 to about 2000 g/m$^2$, about 500 to about 1500 g/m$^2$, or about 600 to about 1200 g/m$^2$. In certain embodiments, the nonwoven composite can have a density of about 0.08 to about 2 g/cm$^3$, about 0.08 to about 1.5 g/cm$^3$, about 0.2 to about 1.5 g/cm$^3$, about 0.2 to about 0.7 g/cm$^3$, or about 0.25 to about 0.6 g/cm$^3$.

The nonwoven composite can comprise other fibers in addition to those described above. For example, in order to increase the flame resistance of the resulting composite, the composite can further comprise flame retardant fibers. As utilized herein, the term "flame retardant fibers" refers to fibers having a Limiting Oxygen Index (LOI) value of about 20.95 or greater, as determined by ISO 4589-1. Alternatively, the fibers contained in the composite (e.g., the natural fibers and/or the binder fibers) can be treated with a flame retardant in order to increase the flame resistance of the composite.

Turning to the figures, in which like reference numerals represent like parts throughout the several views, FIG. 1 depicts one embodiment of a nonwoven composite according to the invention. The nonwoven composite 100 has a first surface 102, a second surface 104, and a thickness extending between the first and second surfaces 102,104. The nonwoven composite comprises a plurality of first fibers 110, which can be any suitable natural fiber as described above, and a plurality of second fibers 120, which can be any suitable binder fiber as described above. The second fibers 120 and the first fibers 110 are interlocked within the nonwoven composite 100. As depicted in FIG. 1, the second fibers 120 can be thermoplastic binder fibers which, upon exposure to heat, partially melt and bond to the adjacent first fibers 110. The nonwoven composite 100 further comprises a VOC-absorbing material 130 dispersed within at least a portion of the nonwoven composite 100. As depicted in FIG. 1, the density of the VOC-absorbing material 130 within the nonwoven composite 100 can be greatest adjacent to the second surface 104 of the nonwoven composite.

Figure 2:
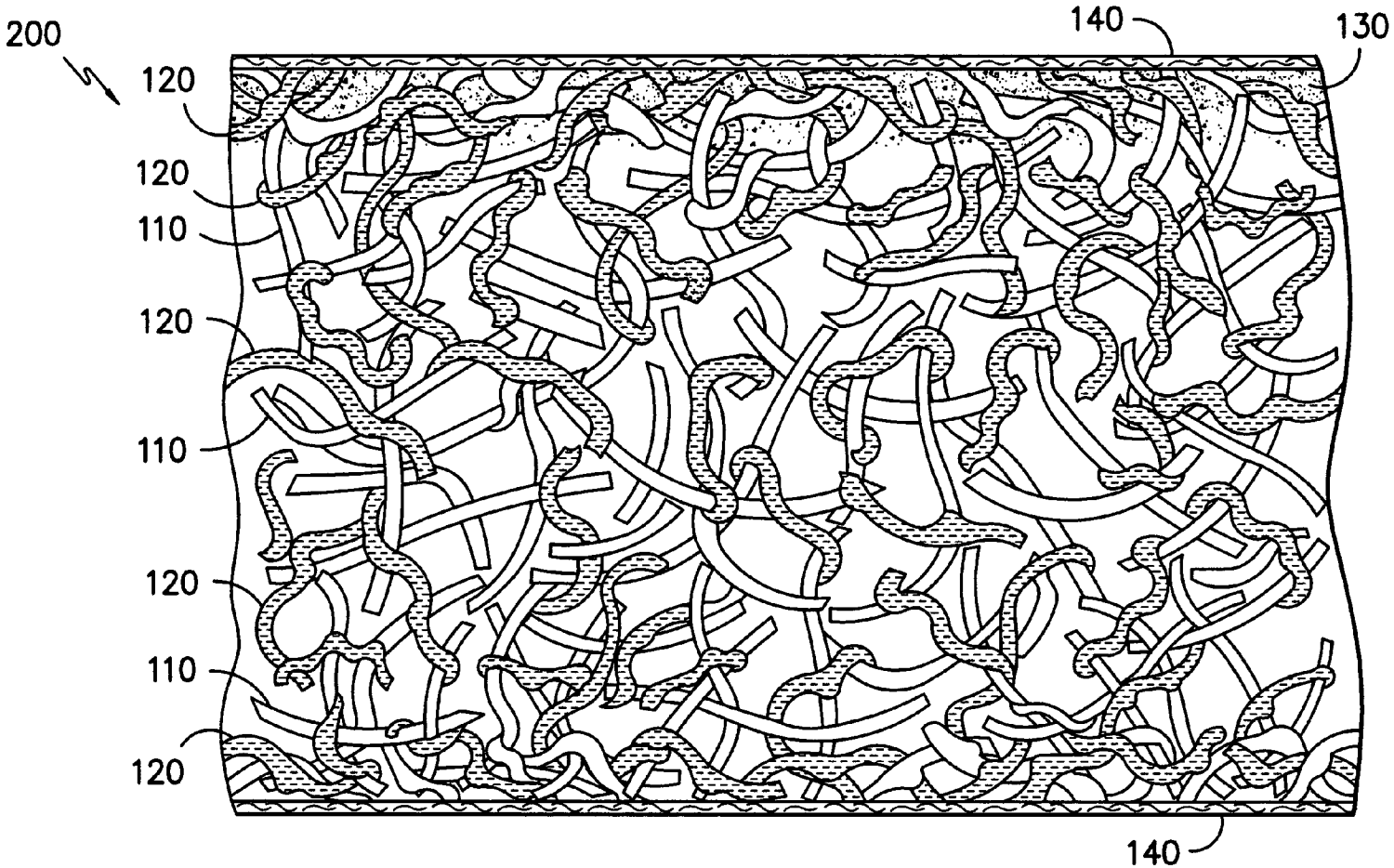
FIG. 2 is a sectional view of another embodiment of a nonwoven composite according to the invention.

FIG. 2 depicts another embodiment of a nonwoven composite according to the invention. As depicted in FIG. 2, the nonwoven composite 200 comprises a plurality of first fibers 110, which can be any suitable natural fiber as described above, and a plurality of second fibers 120, which can be any suitable binder fiber as described above. The second fibers 120 and the first fibers 110 are interlocked within the nonwoven composite 200. The second fibers 120 can be thermoplastic binder fibers which, upon exposure to heat, partially melt and bond to the adjacent first fibers 110. The nonwoven composite 100 further comprises a VOC-absorbing material 130 dispersed within at least a portion of the nonwoven composite 100 and one or more scrims 140 disposed on at least a portion of a surface of the nonwoven composite 200. The scrim 140 can be attached to the surface of the nonwoven composite 200 using any suitable adhesive (not shown) or the scrim 140 can be attached to the surface of the composite 200 via the second fibers 120 (e.g., thermoplastic binder fibers) of the composite 200. While the nonwoven composite depicted in FIG. 2 is shown with a scrim attached to each major surface of the composite, it will be understood that the nonwoven composite can comprise only one scrim attached to at least a portion of one major surface of the composite. As depicted in FIG. 2, the density of the VOC-absorbing material 130 within the nonwoven composite 200 can be greatest adjacent to a surface of the nonwoven composite to which the scrim 140 is attached.

The scrim used in the nonwoven composite can be any suitable material. For example, the scrim can be a woven, knit, or nonwoven textile material comprising natural fibers, synthetic fibers, or combinations thereof. In certain possibly preferred embodiments, the fibers in the scrim 140 are thermoplastic fibers having a melting temperature that is higher than the binder fibers contained in the composite. For example, suitable thermoplastic fibers for the scrim can have a melting temperature of about 200° C. or higher, as well as high thermal stability and low heat deflection at elevated temperatures. In certain possibly preferred embodiments, the scrim is a nonwoven textile material comprising a plurality of thermoplastic fibers, such as polyester fibers. More particularly, the scrim can be a nonwoven textile material comprising a plurality of spunbond thermoplastic (e.g., polyester) fibers. Alternatively, the scrim can be a film, such as a thermoplastic film made from, for example, a polyolefin (e.g., polyethylene, polypropylene, etc.), a polyamide, or a polyester (e.g., polyethylene terephthalate). Scrims suitable for the composite can have any suitable weight. For example, the scrim can have a weight of about 15 to about 35 g/m$^2$ or about 17 to about 34 g/m$^2$.

Figure 3:
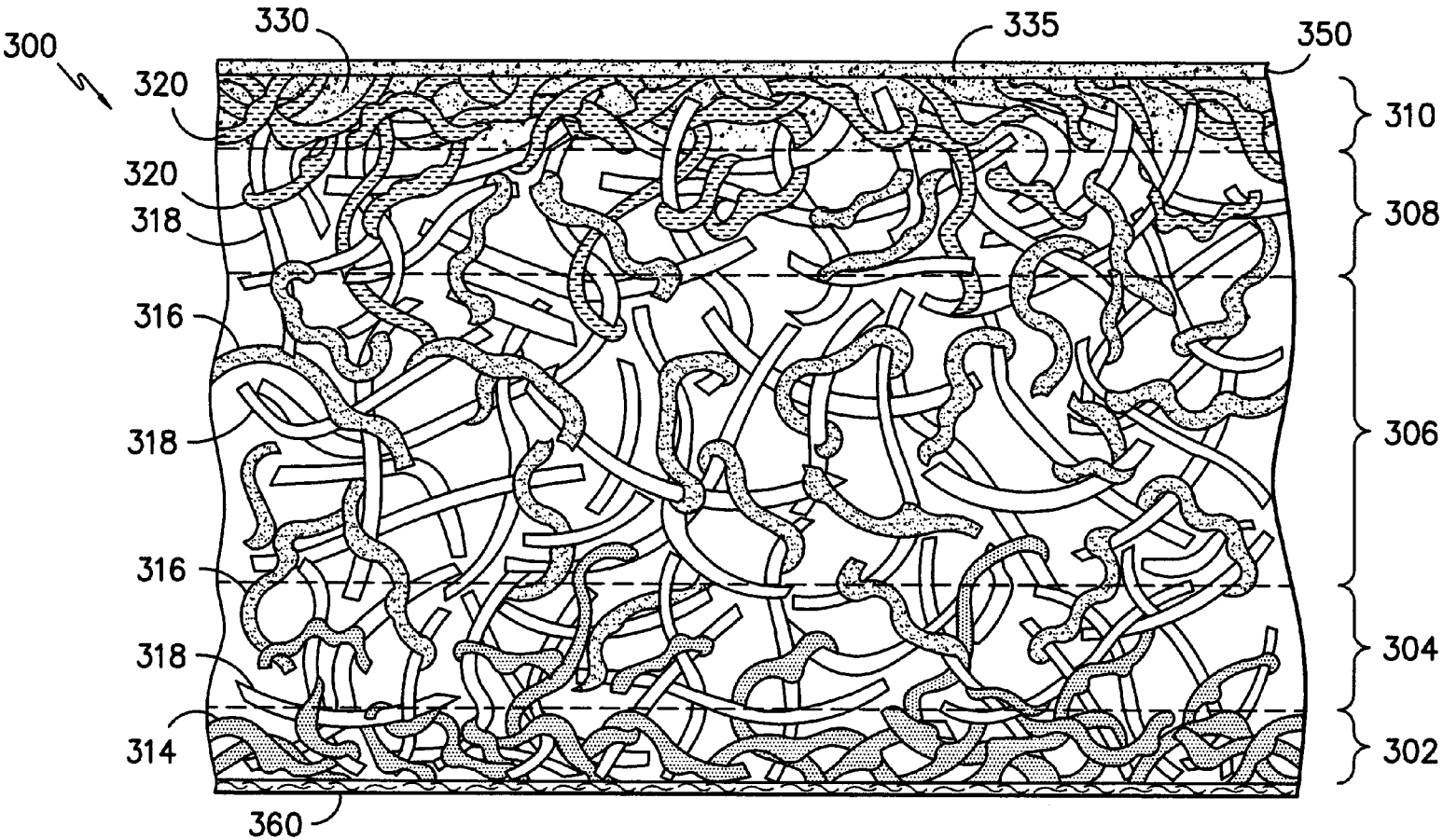
FIG. 3 is a sectional view of another embodiment of a nonwoven composite according to the invention.

FIG. 3 depicts another embodiment of a nonwoven composite according to the invention. As shown in FIG. 3, the nonwoven composite can be a unitary, nonwoven composite comprising a plurality of fibers provided in a plurality of regions within the composite. As utilized herein with reference to the nonwoven composite, the term "unitary" refers to the fact that the enumerated regions of the composite do not form layers having distinct boundaries separating them from the adjacent region(s). Rather, the enumerated regions are used to refer to portions of the composite in which the different fibers are contained in different concentrations. More specifically, the enumerated regions are used to refer to portions of the thickness of the composite in which different fibers predominate or in which the concentration gradient of the fibers (e.g., how the concentration of a particular fiber changes with the thickness of the composite) differs from the adjacent portions (i.e., portions above and/or below) of the composite. Furthermore, while the composite will be described herein as containing particular fibers in specific regions, those of ordinary skill in the art will appreciate that each region of the composite can contain any of the fibers present in the composite. Nevertheless, particular fibers or combinations of fibers will predominate in particular portions of the thickness of the composite, and the enumerated regions described herein are intended to refer to those portions of the composite.

Returning to FIG. 3, one embodiment of a unitary, nonwoven composite 300 comprises a first region 302, a second region 306 disposed above the first region 302, a first transitional region 304 disposed between the first region 302 and the second region 306, and a third region 310 disposed above the second region 306. The first region 302 comprises a binder material, which is depicted as a plurality of first binder fibers 314, and a plurality of natural fibers 318, the second region 306 comprises a plurality of second binder fibers 316 and a plurality of the natural fibers 318, and the third region 310 comprises a plurality of third binder fibers 320 and a plurality of the natural fibers 318. The first transitional region 304 comprises concentrations of the first binder fiber 314, the second binder fiber 316, and the natural fiber 318. The concentration of the first binder fiber 314 in the first transitional region 304 is greatest proximate to the first region 302 and least proximate to the second region 306, and the concentration of the second binder fiber 316 in the first transitional region 304 is greatest proximate to the second region 306 and least proximate to the first region 302.

The natural fibers suitable for use in the disclosed nonwoven composite and method can have any suitable linear density (i.e., denier). For example, the natural fibers can be bast fibers having a linear density of about 8.$\overline{8}$ dtex (8 denier) to about 20 dtex (18 denier).

The binder fibers contained in the nonwoven composite can have any suitable linear density or combination of linear densities. In certain embodiments, each of the different binder fiber types contained in the composite can have different linear densities. For example, as depicted in FIG. 3, the first binder fiber 314 can have a linear density that is less than the linear density of the second binder fiber 316. In such an embodiment, the first binder fiber 314 can have a linear density of about 6.$\overline{6}$ dtex (6 denier) or less (e.g., about 0.$\overline{5}$ dtex (0.5 denier) to about 6.$\overline{6}$ dtex (6 denier)), and the second binder fiber 316 can have a linear density of about 6.$\overline{6}$ dtex (6 denier) to about 22.$\overline{2}$ dtex (22 denier). In certain embodiments, the first binder fiber can have a linear density of about 1.$\overline{6}$ dtex (1.5 denier), and the second binder fiber can have a linear density of about 11.$\overline{1}$ dtex (10 denier).

The binder material contained in the third region can be any suitable binder material. For example, the binder material can comprise a layer of thermoplastic material that has been laminated to the upper surface of the second region. Such a layer can be formed, for example, by depositing thermoplastic particles onto the upper surface of the second region and at least partially melting the particles to bond them to the fibers contained in the second region. As depicted in FIG. 3, the binder material in the third region 310 can comprise a third binder fiber 320, and the composite 300 can comprise a second transitional region 308 disposed between the second region 306 and the third region 310. In this embodiment, the second transitional region 308 comprises concentrations of the second binder fiber 316, the natural fiber 318, and the third binder fiber 320. The concentration of the second binder fiber 316 in the second transitional region 308 is greatest proximate to the second region 306 and least proximate to the third region 310, and the concentration of the third binder fiber 320 in the second transitional region 308 is greatest proximate to the third region 310 and least proximate to the second region 306.

The binder fibers suitable for use in the above-described third region 310 of the composite 300 can be any suitable binder fibers, including those described above as suitable for use as the first and second binder fibers. As with the first and second binder fibers, the third binder fibers can have any suitable linear density. In certain embodiments, the third binder fibers 320 have a linear density that is greater than the linear density of the first and second binder fibers 314, 316. For example, the third binder fibers 320 can have a linear density of about 22.$\overline{2}$ dtex (22 denier) or more (e.g., about 22.$\overline{2}$ dtex (22 denier) to about 72.$\overline{2}$ dtex (65 denier)). In certain possibly preferred embodiments, the third binder fibers can have a linear density of about 35.$\overline{5}$ dtex (32 denier).

As depicted in FIG. 3, the VOC-absorbing material 330 can be dispersed within one or more regions of the nonwoven composite 300. For example, as shown in FIG. 3, the VOC-absorbing material 330 can be dispersed within or incorporated into the third region 310 of the nonwoven composite 300. The density of the VOC-absorbing material 330 within the third region 310 can vary within the thickness of the nonwoven composite 300 such that the density of the VOC-absorbing material 330 is greatest adjacent to or at the surface of the nonwoven composite 300 adjacent to the third region 310 and diminishes through the thickness of the nonwoven composite 300 moving towards the second transitional region 308 of the composite.

The nonwoven composite can, in certain embodiments, further comprise an absorbent coating on a surface thereof. For example, as depicted in FIG. 3, the nonwoven composite 300 can comprise an absorbent coating 350 disposed on the surface of the composite proximate to the region containing the VOC-absorbing material 330, which is the third region 310 of the nonwoven composite 300 depicted in FIG. 3. The absorbent coating 350 can comprise any suitable VOC-absorbing material, including those described above. As shown in FIG. 3, the VOC-absorbing material 335 contained in the absorbent coating 350 can be the same as the VOC-absorbing material 330 dispersed within the nonwoven composite 300. The absorbent coating 350 can, in certain embodiments, further comprise a suitable adhesive, such as those described above, to provide structure to the coating and promote adhesion between the coating and the adjacent fiber-containing portions of the nonwoven composite (e.g., the third region 310 as depicted in FIG. 3). Also, the adhesive contained in the absorbent coating 350 or any portion thereof can be derived from thermoplastic binder fibers present in the region of the nonwoven composite adjacent to the absorbent coating, which fibers have been melted such that the thermoplastic material has contacted at least a portion of the VOC-absorbing material 335 in the absorbent coating 350.

As noted above, the nonwoven composite can, in certain embodiments, further comprise a scrim disposed on a surface thereof. For example, as depicted in FIG. 3, the nonwoven composite 300 can comprise a scrim 360 disposed on the surface adjacent the first region 302. The scrim 360 can be any suitable scrim, such as those described above in the discussion of FIG. 2, and can be attached to the surface adjacent the first region 302 by any suitable means, such as those described above in the discussion of FIG. 2.

Figure 4:
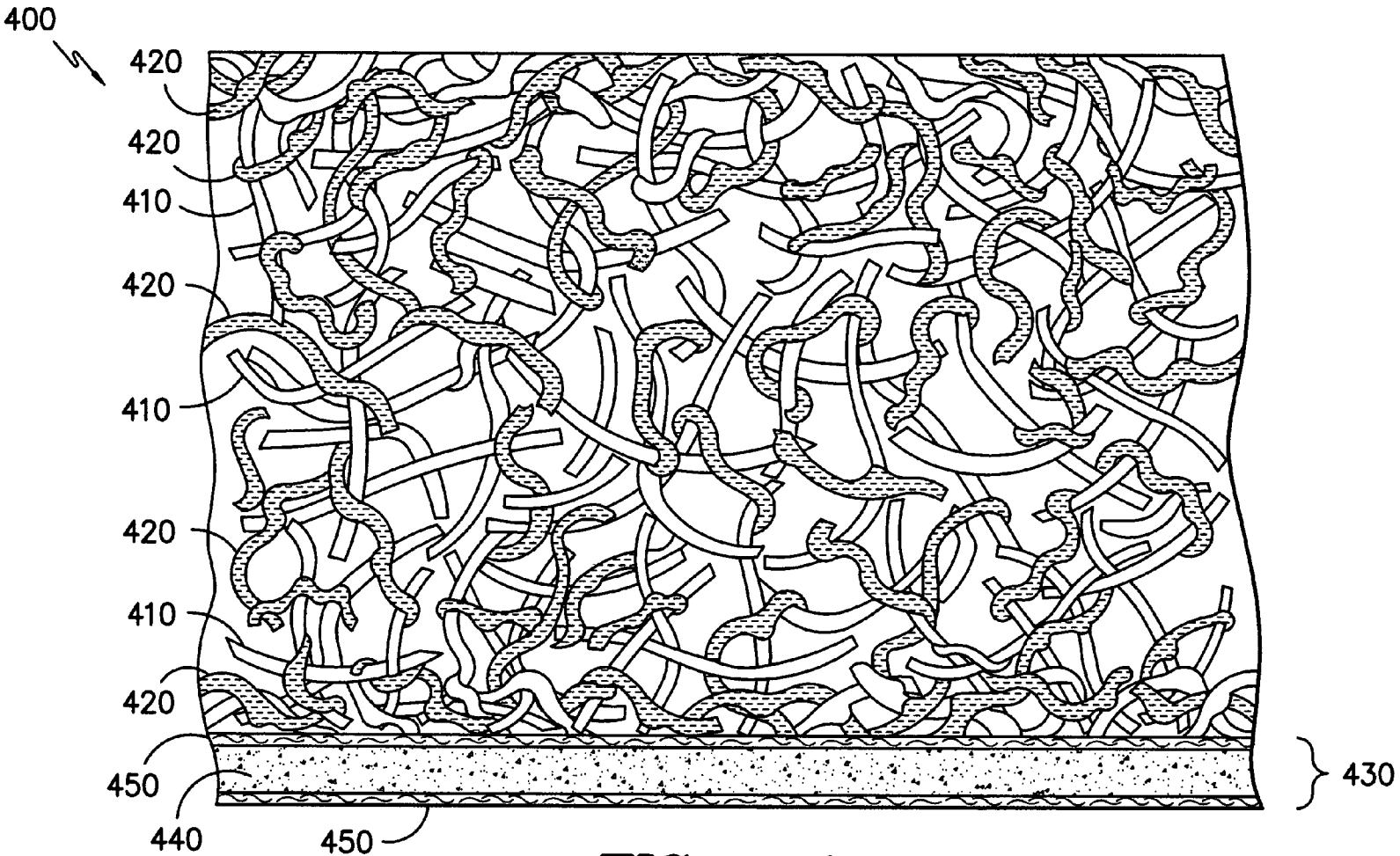
FIG. 4 is a sectional view of another embodiment of a nonwoven composite according to the invention.

In certain embodiments of a nonwoven composite according to the invention, the VOC-absorbing material can be incorporated into an absorbent layer that is adhered or attached to a surface of the nonwoven composite. One example of a nonwoven composite incorporating such an absorbent layer is depicted in FIG. 4. As shown in FIG. 4, the nonwoven composite 400 comprises a plurality of first fibers 410, which can be any suitable natural fiber as described above, and a plurality of second fibers 420, which can be any suitable binder fiber as described above. The second fibers 420 and the first fibers 410 are interlocked within the nonwoven composite 400. As depicted in FIG. 4, the second fibers 420 can be thermoplastic binder fibers which, upon exposure to heat, partially melt and bond to the adjacent first fibers 410. The nonwoven composite 400 further comprises an absorbent layer 430 disposed on at least one surface of the nonwoven composite 400. As depicted in FIG. 4, the absorbent layer 430 can comprise a VOC-absorbing material 440 disposed between a pair of scrims 450. The VOC-absorbing material 440 and the scrims 450 utilized in the absorbent layer 430 can be any suitable materials and scrims, including those described above. The absorbent layer can further comprise a suitable adhesive, such as those described above, to provide structure to the absorbent layer and promote adhesion between the scrims 450 and the VOC-absorbing material 440. The absorbent layer 430 can be attached or bonded to the fiber-containing portion of the nonwoven composite 400 using any suitable means. For example, the absorbent layer 430 can be adhered thereto using a suitable adhesive or through bonding between thermoplastic binder fibers in the composite (e.g., second fibers 420) and the scrim 450.

Figure 5:
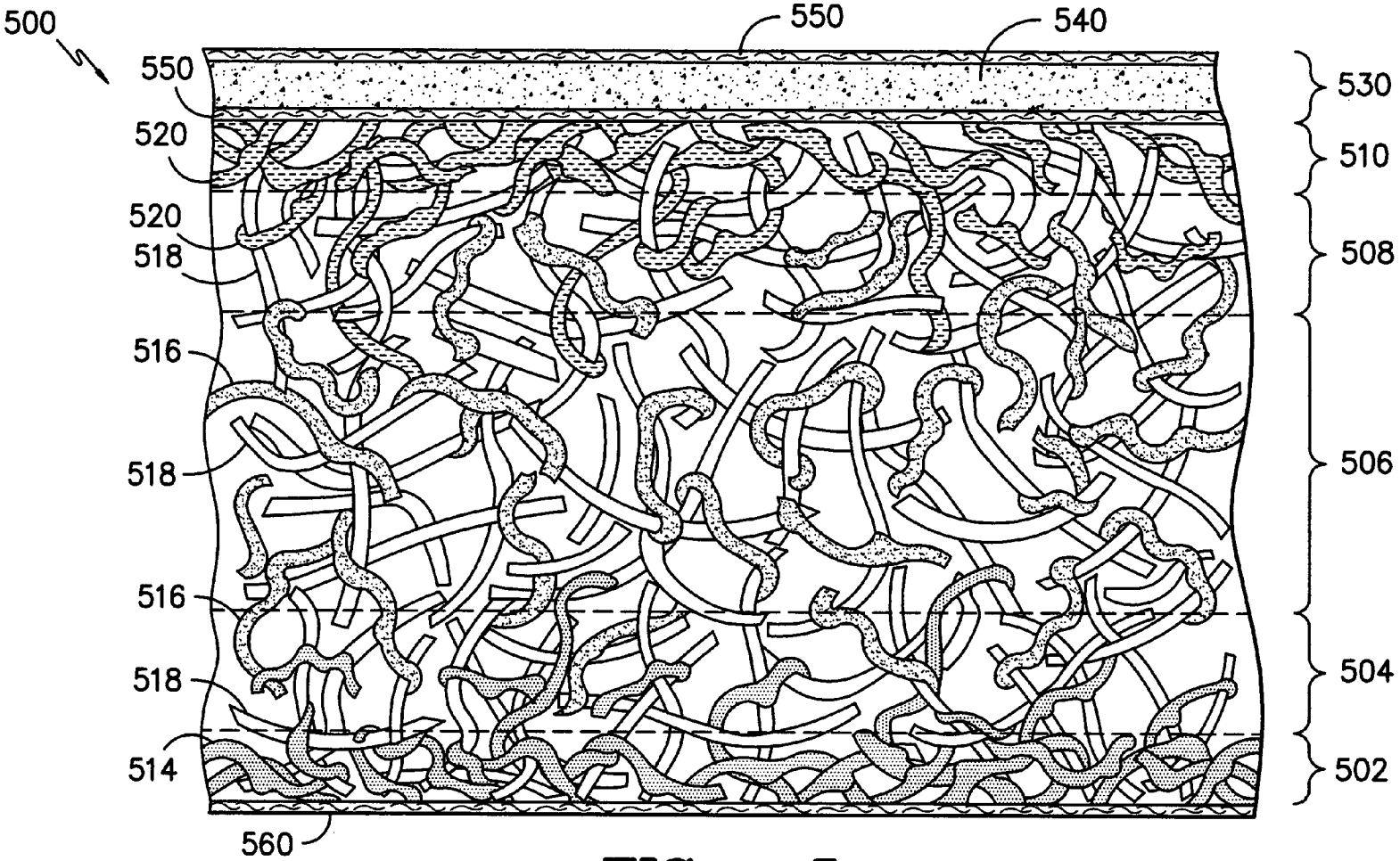
FIG. 5 is a sectional view of another embodiment of a nonwoven composite according to the invention.

Another embodiment of a nonwoven composite according to the invention is depicted in FIG. 5. In FIG. 5, one embodiment of a unitary, nonwoven composite 500 comprises a first region 502, a second region 506 disposed above the first region 502, a first transitional region 504 disposed between the first region 502 and the second region 506, a third region 510 disposed above the second region 506, and a second transitional region 508 disposed between the second region 506 and the third region 510. The first region 502 comprises a binder material, which is depicted as a plurality of first binder fibers 514, and a plurality of natural fibers 518, the second region 506 comprises a plurality of second binder fibers 316 and a plurality of the natural fibers 518, and the third region 510 comprises a plurality of third binder fibers 520 and a plurality of the natural fibers 518. The first transitional region 504 comprises concentrations of the first binder fiber 514, the second binder fiber 516, and the natural fiber 518. The concentration of the first binder fiber 514 in the first transitional region 504 is greatest proximate to the first region 502 and least proximate to the second region 506, and the concentration of the second binder fiber 516 in the first transitional region 504 is greatest proximate to the second region 506 and least proximate to the first region 502. The second transitional region 508 comprises concentrations of the second binder fiber 516, the natural fiber 518, and the third binder fiber 520. The concentration of the second binder fiber 516 in the second transitional region 508 is greatest proximate to the second region 506 and least proximate to the third region 510, and the concentration of the third binder fiber 520 in the second transitional region 508 is greatest proximate to the third region 510 and least proximate to the second region 506.

The nonwoven composite 500 can further comprise an absorbent layer 530 disposed on a surface thereof. As depicted in FIG. 5, the absorbent layer 530 can be disposed on the surface of the nonwoven composite 500 adjacent to the third region 510 of the composite. The absorbent layer 530 comprises a VOC-absorbing material 540 disposed between two scrims 550. The absorbent layer 530 and the components thereof (e.g., the VOC absorbing material and scrims) can be the same as those described above in the discussion of the nonwoven composite depicted in FIG. 4.

As depicted in FIG. 5, the nonwoven composite 500 can comprise a scrim 560 disposed on the surface adjacent the first region 502. The scrim 560 can be any suitable scrim, such as those described above in the discussion of FIG. 2, and can be attached to the surface adjacent the first region 502 by any suitable means, such as those described above in the discussion of FIG. 2.

Figure 6:
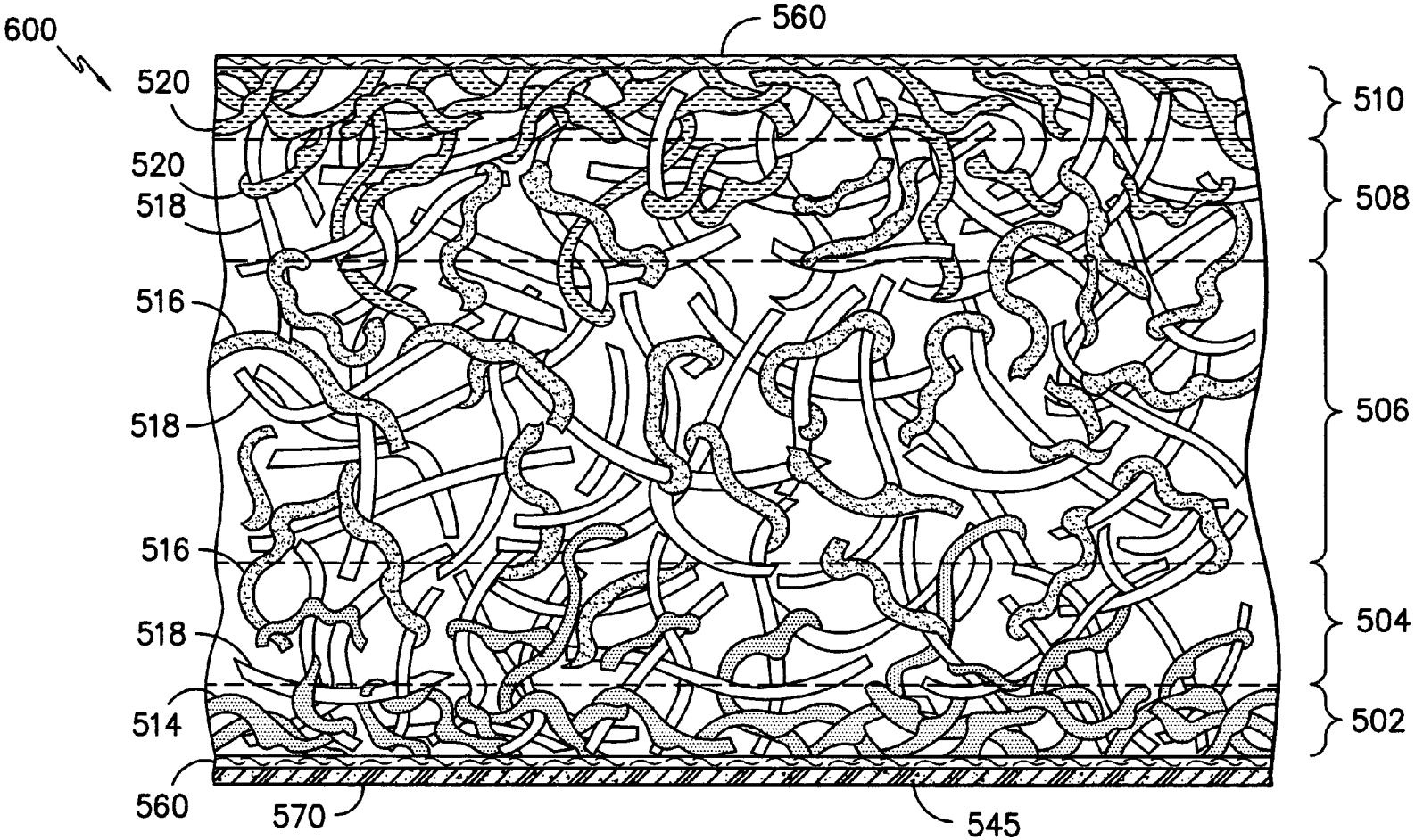
FIG. 6 is a sectional view of another embodiment of a nonwoven composite according to the invention.

As noted above, the VOC-absorbing material can be incorporated into a film that is applied to a surface of the nonwoven composite. One embodiment of such a composite is depicted in FIG. 6. As shown in FIG. 6, the nonwoven composite 600 can comprise a scrim 560 disposed on the surface adjacent the first region 502. The nonwoven composite 600 can also comprise a scrim 560 disposed on the surface adjacent the third region 510. The scrims 560 can be any suitable scrims, such as those described above in the discussion of FIG. 2, and can be attached to the surface adjacent the first region 502 by any suitable means, such as those described above in the discussion of FIG. 2. As depicted in FIG. 6, the film 570 can be disposed adjacent to the scrim 560 attached to the surface adjacent the first region 502 of the composite 600. The film 570 can, as described above, comprise a thermoplastic material and have a VOC-absorbing material 545, such as those described above, dispersed therein. While the nonwoven composite in FIG. 6 has been depicted with the film 570 disposed adjacent to the scrim 560 attached to the surface adjacent the first region 502 of the composite 600, the film 570 can be disposed adjacent to or directly attached to the surface adjacent the first region 502 of the composite 600. The film 570 can alternatively or additionally be disposed adjacent to or directly attached to the surface adjacent the third region 510 of the composite 600.

In certain possibly preferred embodiment, a nonwoven composite according to the invention can comprise an antimicrobial agent. While not wishing to be bound to any particular theory, it is believed that incorporation of an antimicrobial agent into the nonwoven composite can help in further reducing odors within an environment by hindering the growth of bacteria and mold that may generate odor. The antimicrobial agent can be any suitable antimicrobial agent. Suitable antimicrobial agents include, but are not limited to, pyrithione salts (e.g., zinc pyrithione and sodium pyrithione), isothiazolinones (e.g., methylchloroisothiazolinone and methylisothiazolinone). The antimicrobial agent may be incorporated into the nonwoven composite in any suitable manner. For example, the antimicrobial agent may be applied to a surface of the nonwoven composite by spraying or padding it onto the surface before the nonwoven composite is heated, as described below. Alternatively, the antimicrobial agent may be applied to at least a portion of the fibers before the fibers are formed into the nonwoven composite. In such an embodiment, a treating composition containing the antimicrobial agent can be sprayed or otherwise applied to the fibers while bails of fibers are being opened to produce fibers suitable for use in forming the nonwoven composite. When the nonwoven composite comprises a scrim, the scrim may be pretreated with the antimicrobial agent by conventional spraying or padding techniques.

The nonwoven composite described above and produced by the method described below can be utilized in a variety of applications. For example, the composite can be used as the substrate for an automobile headliner, an automobile door panel, a panel used in office furniture, etc. In one embodiment, the composite comprises the structural support for an automobile headliner. In such an embodiment, the composite can have a fabric layer adhered to one surface with or without the use of an additional adhesive. For example, in certain embodiments, the binder material disposed on the surface of the composite can provide sufficient tack for the fabric to adhere to the surface of the composite. Such an automobile headliner can also comprise a layer of foam or other suitable material (e.g., batting) disposed between the composite and the fabric layer. While not wishing to be bound to any particular theory, it is believed that the incorporation of the VOC-absorbing material into the composite can, when the composite is used in an automobile interior, help reduce the concentration of VOCs in the automobile's interior by absorbing and/or adsorbing at least a portion of the VOCs emitted by the automobile's other interior components (e.g., the components produced from foams, plastics, vinyl materials, etc.). Furthermore, it is believed that the incorporation of the VOC-absorbing material into the composite can aid in reducing the amount of VOCs that natural fibers and/or binders fibers can themselves generate when the composite is exposed to the relatively high temperatures that an automobile's passenger compartment may reach.

A method for producing a nonwoven composite is also described herein. In one embodiment, the method comprises the steps of providing a plurality of first binder fibers having a first linear density, a plurality of second binder fibers having a second linear density, and a plurality of natural fibers. The pluralities of first binder fibers, second binder fibers, and natural fibers are then blended to produce a fiber blend, and the fiber blend is then projected onto a moving belt such that a fibrous mat or fiber-containing composite is formed. In this method, the second linear density can be greater than the first linear density, such that the fibers are deposited onto the moving belt in regions or strata comprising different relative concentrations of the fibers. In particular, the fiber-containing composite produced by such a method can comprise a collection of different regions such as that depicted in FIG. 3 and described above. After fiber-containing composite has been formed, a VOC-absorbing material, such as that described above, can be deposited onto a surface of the fiber-containing composite to yield a nonwoven composite. Depositing the VOC-absorbing material onto the fiber-containing composite at this stage not only allows the VOC-absorbing material to be deposited onto the surface of the fiber-containing composite defined by the outermost fibers, but also permits at least a portion of the VOC-absorbing material to fall between those outermost fibers and at least partially fill a portion of the interstitial spaces defined by the fibers contained within those portions of the fiber-containing composite underlying the surface. This "trickling down" of the VOC-absorbing material into these interstitial spaces can result in a nonwoven composite in which the density of the VOC-absorbing material within the composite is greatest at the surface where it was deposited and then decreases through the thickness of the composite moving away from that surface. For example, the density of the VOC-absorbing material can vary according to a gradient exhibiting a maximum density at this surface and then gradually decreasing through the thickness of the composite moving away from that surface.

In a further embodiment of the method described herein, the first step comprises providing a plurality of third binder fibers having a third linear density, and the second step comprises blending the pluralities of first, second, and third binder fibers and the natural fibers to produce the fiber blend. The resulting fiber blend is then projected onto the moving belt in the same or similar manner as that utilized in the first method embodiment. In this embodiment, the third linear density can be greater than the first and second linear densities. The fiber-containing composite produced by such a method can comprise a collection of different regions such as that depicted in FIG. 3 and described above.

The fibers suitable for use in the above-described methods can be any suitable binder fibers and natural fibers. For example, the first, second, third, and natural fibers suitable for use in the described methods can be the same as those discussed above with respect to the various embodiments of the unitary, fiber-containing composite.

In certain embodiments of the described methods, such as when at least one of the binder fibers is a thermoplastic binder fiber, the nonwoven composite produced by the above-described steps can be heated to at least partially melt the thermoplastic binder fiber and bond together at least a portion of the fibers contained in the composite. For example, the method can further comprise the step of passing heated air through the nonwoven composite produced by the above-described embodiments to partially melt all or a portion of the binder fibers. As will be understood by those of ordinary skill in the art, the nonwoven composite can be heated by other means, such as infrared radiation. This step serves to set an initial thickness for the composite of, for example, about 5 to about 50 mm or about 10 to about 50 mm.

In another embodiment of the method described herein, the nonwoven composite can be compressed to produce a composite having a density and/or a rigidity that are high enough for the composite to act as a structural support, for example, for an automobile headliner. In such an embodiment, the method can further comprise the step of heating the nonwoven composite produced in the above-described embodiments using, for example, a hot belt laminator, which concentrates heat on the surfaces of the composite. Such heating further melts the first, second, and third binder fibers, and the compressive forces exerted on the composite by the laminator serve to retain the fibers in a compressed state while it is heated and the binder fibers are at least partially melted.

Figure 7A:
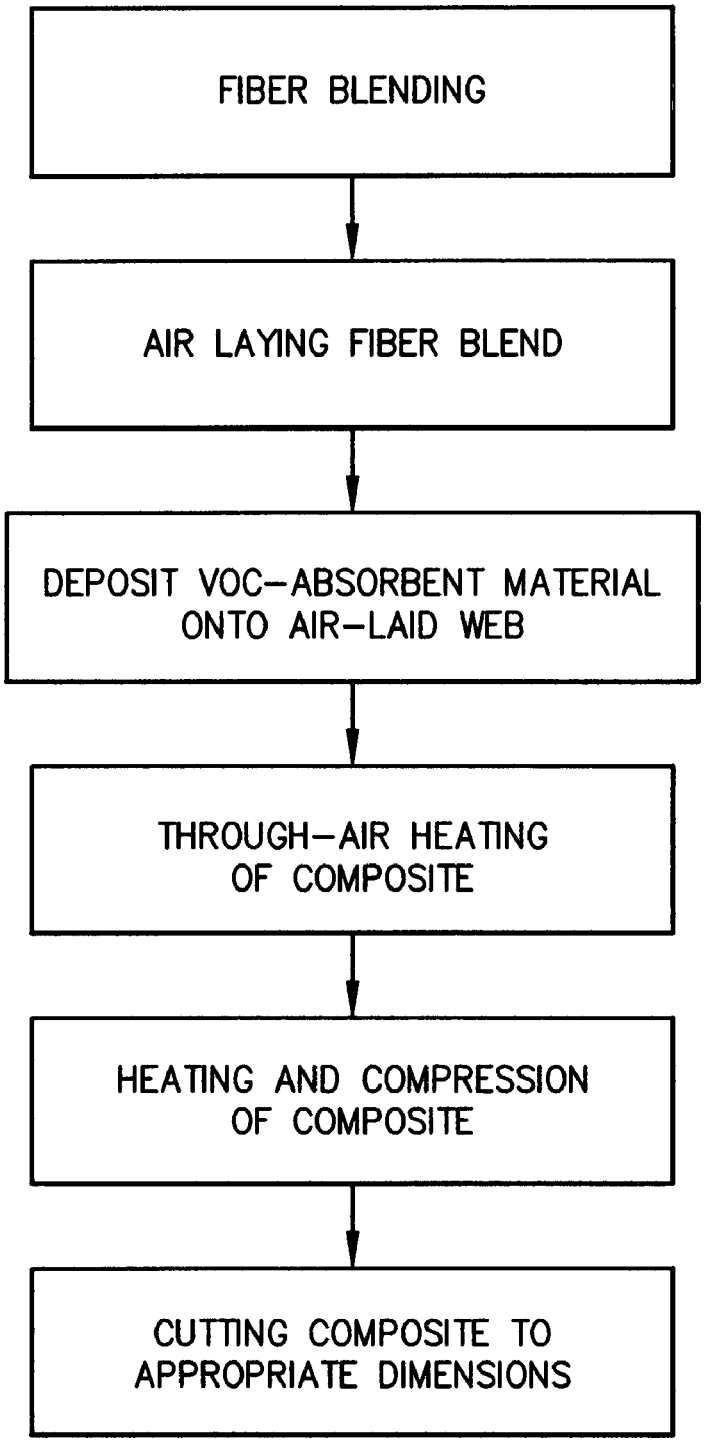
FIG. 7A is a schematic representation of the steps of a method for producing a nonwoven composite according to the invention.
Figure 7B:
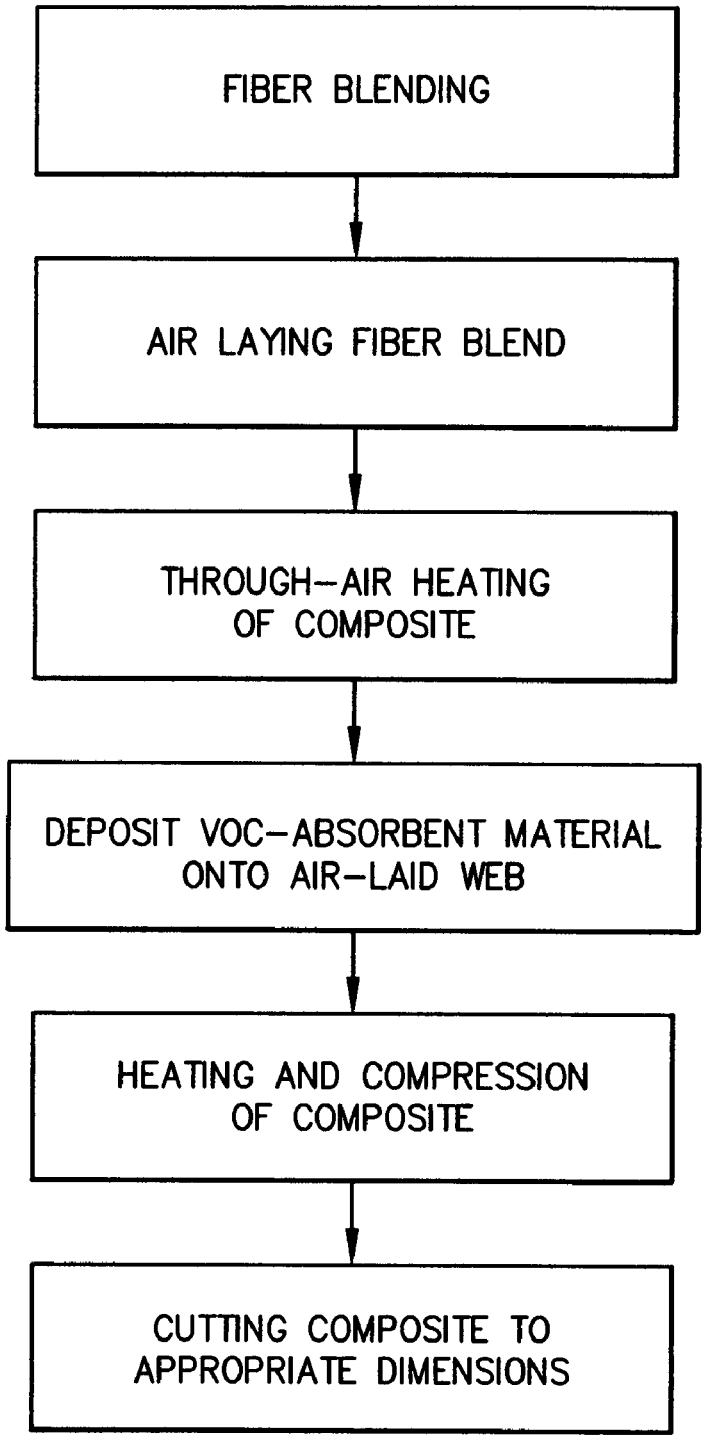
FIG. 7B is a schematic representation of the steps of a method for producing a nonwoven composite according to the invention.

The steps of an embodiment of a method according to the invention are schematically depicted in FIG. 7A. As set forth in the figure, the first step of the described method is blending the pluralities of fibers to produce a fiber blend, which is then air-laid to produce an air-laid web or fiber-containing composite. A VOC-absorbent material is then deposited onto the air-laid web or fiber-containing composite. The resulting composite can then be through-air heated to initially set the fibers within the composite or partially melt any thermoplastic binder fibers contained in the composite. The resulting composite can then be subjected to a second heating step and compression step to further set the fibers or melt any thermoplastic binder fibers contained in the composite. The resulting nonwoven composite can then be cut to the dimensions appropriate for the desired end use. The steps of another embodiment of a method are schematically depicted in FIG. 7B. In this method, the steps of depositing the VOC-absorbing material and through-air heating of the composite are switched so that the air-laid web or fiber-containing composite is first through-air heated and the VOC-absorbing material is then deposited onto the surface of the composite.

Figure 8:
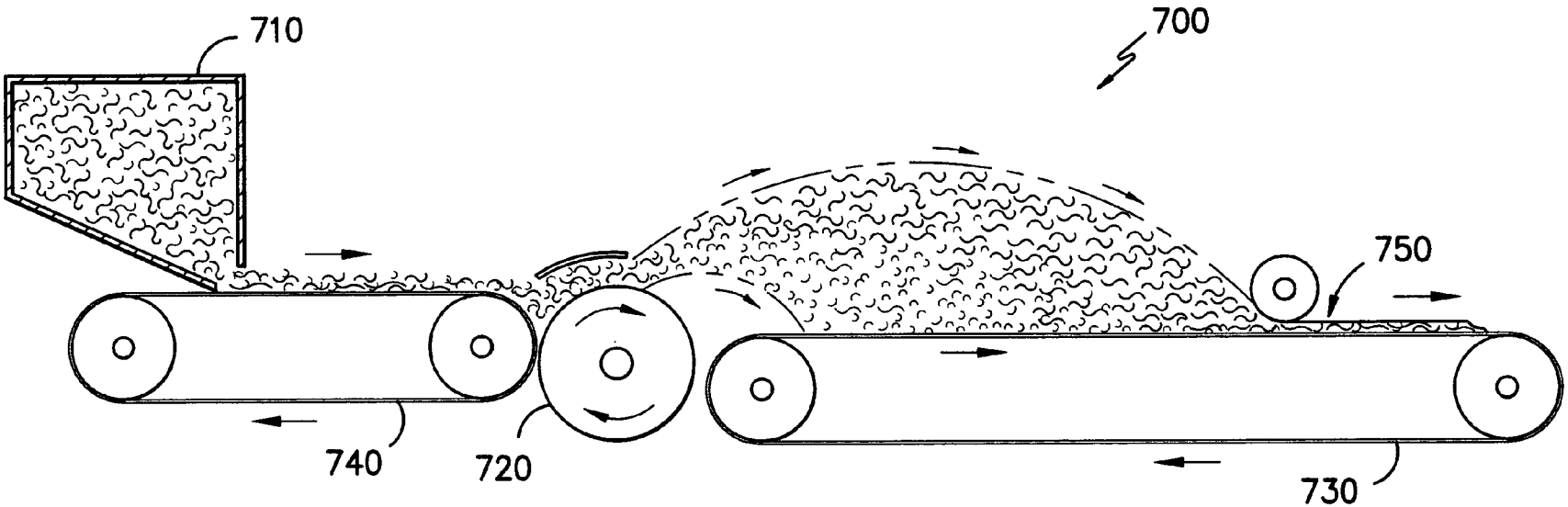
FIG. 8 is an elevation view of an apparatus suitable for performing the methods described in the current specification.

An apparatus suitable for performing the above-described method is depicted in FIG. 8. A commercially available piece of equipment that has been found to be suitable for carrying out the above-described method is the "K-12 HIGH-LOFT RANDOM CARD" by Fehrer AG (Linz, Austria). In the apparatus 700 depicted in FIG. 7, the binder fibers and natural fibers are blended in the appropriate proportions and introduced into a feed chute 710. The feed chute 710 delivers the blended fibers to a transverse belt 740 that delivers a uniform thickness or batt of fibers to an air lay machine comprising a cylinder 720. The cylinder 720 rotates and slings the blended fibers towards a collection belt 730. The collection belt 730 typically comprises a plurality of perforations in its surface (not shown) so that a vacuum can be drawn across the belt to help the fibers properly settle on the collection belt 730. The rotation of the cylinder 720 slings the fibers having a higher linear density a further distance along the collection belt 730 than it slings the fibers having a lower linear density. As a result, the fiber-containing composite 750 collected on the collection belt 730 will have a greater concentration of the fibers with a lower linear density adjacent to the collection belt 730, and a greater concentration of the fibers with a higher linear density further away from the collection belt 730. In general, the larger the difference in linear density between the fibers, the greater the gradient will be in the distribution of the fibers.

The nonwoven composite can be further processed using convention "cold mold" thermoforming equipment in which the composite is first heated and then pressed to the appropriate shape and thickness using an unheated mold. In such an embodiment of the method, the composite can be heated to a temperature of about 170 to about 215° C. during a heating cycle of about 30 to about 120 seconds using, for example, infrared radiation. The heated composite is then placed inside a mold, which typically is maintained at a temperature of about 10 to about 30° C., and compressed to the appropriate shape and thickness. The compression step typically is about 1 minute in length, during which time the thermoplastic binder fibers will cool to such an extent that the composite will maintain substantially the compressed configuration upon removal from the mold. As will be understood those of ordinary skill in the art, owing at least partially to the rigidity of the bast fibers, the composite may expand (for example, in the z-direction) upon heating and before being placed in the mold.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A nonwoven composite having a first surface and a second surface, the nonwoven composite comprising:

(a) a plurality of bast fibers, (b) a plurality of binder fibers, the plurality of binder fibers comprising a plurality of first thermoplastic binder fibers and a plurality of second thermoplastic binder fibers, wherein the first binder fibers have a first linear density, the second binder fibers have a second linear density, and the second linear density is greater than the first linear density, and wherein the binder fibers being bonded to or interlocked with the bast fibers, and (c) a thermoplastic film disposed on at least one of the first and second surfaces of the nonwoven composite, the thermoplastic film comprising a volatile organic compound absorbing material dispersed therein, wherein the composite further comprises:

(i) a first region comprising a plurality of first thermoplastic binder fibers and a plurality of bast fibers;

(ii) a second region disposed above the first region with respect to the thickness of the composite, the second region comprising a plurality of second thermoplastic binder fibers, and a plurality of bast fibers, at least a portion of the second region defining the second surface of the nonwoven composite; and (iii) a first transitional region disposed between the first region and the second region, the first transitional region comprising concentrations of the first binder fiber, the second binder fiber, and the bast fiber, the concentration of the first binder fiber in the first transitional region being greatest proximate to the first region and least proximate to the second region, and the concentration of the second binder fiber in the first transitional region being greatest proximate to the second region and least proximate to the first region.

2. The nonwoven composite of claim 1, wherein the volatile organic compound absorbing material is activated carbon.

3. The nonwoven composite of claim 1, wherein the bast fibers are selected from the group consisting of jute fibers, kenaf fibers, hemp fibers, flax fibers, ramie fibers, roselle fibers, and combinations thereof.

4. The nonwoven composite of claim 1, wherein the composite further comprises an antimicrobial agent dispersed within the nonwoven composite.

5. The nonwoven composite of claim 1, wherein the plurality of binder fibers further comprises a plurality of third thermoplastic binder fibers, and the composite comprises:

(i) a first region comprising a plurality of first thermoplastic binder fibers and a plurality of bast fibers;

(ii) a second region disposed above the first region with respect to the thickness of the composite, the second region comprising a plurality of second thermoplastic binder fibers, and a plurality of bast fibers;

(iii) a first transitional region disposed between the first region and the second region, the first transitional region comprising concentrations of the first binder fiber, the second binder fiber, and the bast fiber, the concentration of the first binder fiber in the first transitional region being greatest proximate to the first region and least proximate to the second region, and the concentration of the second binder fiber in the first transitional region being greatest proximate to the second region and least proximate to the first region;

(iv) a third region disposed above the second region with respect to the thickness of the composite, the third region comprising a plurality of third thermoplastic binder fibers and a plurality of bast fibers, at least a portion of the third region defining the second surface of the nonwoven composite; and (v) a second transitional region disposed between the second region and the third region, the second transitional region comprising concentrations of the second binder fiber, the bast fiber, and the third binder fiber, the concentration of the second binder fiber in the second transitional region being greatest proximate to the second region and least proximate to the third region, and the concentration of the third binder fiber in the second transitional region being greatest proximate to the third region and least proximate to the second region.

6. The nonwoven composite of claim 5, wherein the first binder fibers have a first linear density, the second binder fibers have a second linear density that is greater than the first linear density, and the third binder fibers have a third linear density that is greater than the first and second linear densities.

* * * * *